US012116797B2

(12) United States Patent
Verba et al.

(10) Patent No.: US 12,116,797 B2
(45) Date of Patent: Oct. 15, 2024

(54) PORTABLE SHADE SYSTEM

(71) Applicant: The Flying Nautilus, LLC, Atlanta, GA (US)

(72) Inventors: Carrie Verba, Atlanta, GA (US); Curt Jackson, Atlanta, GA (US)

(73) Assignee: THE FLYING NAUTILUS, LLC, Atlanta, GA (US)

( * ) Notice: Subject to any disclaimer, the term of this patent is extended or adjusted under 35 U.S.C. 154(b) by 150 days.

(21) Appl. No.: 18/083,648

(22) Filed: Dec. 19, 2022

(65) Prior Publication Data

US 2024/0200355 A1 Jun. 20, 2024

(51) Int. Cl.

| | |
|---|---|
| ***E04H 15/00*** | (2006.01) |
| ***E04H 15/36*** | (2006.01) |
| ***E04H 15/40*** | (2006.01) |
| ***E04H 15/44*** | (2006.01) |
| ***E04H 15/54*** | (2006.01) |
| ***E04H 15/58*** | (2006.01) |

(52) U.S. Cl.

CPC ..... *E04H 15/54* (2013.01); *E04H 15/003* (2013.01); *E04H 15/36* (2013.01); *E04H 15/40* (2013.01); *E04H 15/44* (2013.01)

(58) Field of Classification Search

CPC ..... E04H 15/54; E04H 15/36; E04H 15/40; E04H 15/44; E04H 15/58; E04H 15/003

USPC ..... 40/215, 217, 602

See application file for complete search history.

(56) References Cited

U.S. PATENT DOCUMENTS 1,409,316 A * 3/1922 Smith ..... E04H 15/003 135/902
1,674,990 A * 6/1928 Peterson ..... E04H 15/003 135/120.4
2,619,101 A * 11/1952 McGerry ..... E04H 15/003 135/117
2,652,845 A * 9/1953 O'Neill ..... E04H 15/003 135/90
2,970,600 A * 2/1961 Schultz ..... E04H 15/003 135/900
3,070,107 A * 12/1962 Beatty ..... E04H 15/003 D30/118
3,226,737 A * 1/1966 William ..... E04H 15/56 135/120.1
3,448,748 A * 6/1969 Walrave ..... E04H 15/28 135/120.3
4,558,862 A * 12/1985 Kelly ..... G01P 5/02 116/273
4,685,484 A * 8/1987 Moneta ..... E04H 15/003 135/900

(Continued)

*Primary Examiner* — Robert Canfield

(74) *Attorney, Agent, or Firm* — Carlson, Gaskey & Olds, P.C.

(57) ABSTRACT

The present disclosure is directed to a system and method for providing shade from sunlight. In some aspects, the techniques described herein relate to a portable shade system for providing shade from sunlight, including: a frame; and a canopy, wherein the canopy includes a first edge and a second edge opposite the first edge, wherein the canopy is connected to the frame adjacent the first edge, wherein the second edge is partially supported by a wind force, wherein the canopy includes pockets adjacent the first edge of the canopy, and wherein the pockets are configured to hold material to maintain a position of the canopy relative to the frame.

14 Claims, 7 Drawing Sheets

(56) References Cited

U.S. PATENT DOCUMENTS 4,846,205 A * 7/1989 Knoll ..... E04H 15/003 403/291
6,286,531 B1 * 9/2001 Joo-Tai ..... E04H 15/60 135/114
7,789,097 B1 * 9/2010 Sotirkys ..... E04H 15/06 135/88.01
9,051,756 B1 * 6/2015 Jenkins ..... E04H 15/58
10,190,330 B2 1/2019 Barnes et al.
10,753,117 B2 8/2020 Barnes et al.
11,111,690 B2 9/2021 Barnes et al.
11,219,286 B2 1/2022 Cox
11,255,103 B2 2/2022 Barnes et al.
D945,019 S * 3/2022 Fraser ..... E04H 15/405 D21/837
11,299,904 B2 4/2022 Barnes et al.
11,686,120 B1 * 6/2023 Yates ..... E04H 15/44 135/143
D1,016,950 S * 3/2024 Liao ..... D21/837
D1,030,296 S * 6/2024 Cai ..... D21/837
2009/0158631 A1 * 6/2009 Christiansen ..... G06Q 30/0256 40/607.04
2009/0283120 A1 * 11/2009 Varga ..... A45B 15/00 160/127
2009/0301531 A1 * 12/2009 Elder ..... A45B 11/00 135/33.7
2014/0041703 A1 * 2/2014 Funston ..... E04H 15/54 135/121
2015/0354244 A1 * 12/2015 Fernández González ..... E04H 15/58 244/153 R
2015/0376912 A1 * 12/2015 Livacich ..... E04H 15/60 135/120.3
2017/0152673 A1 * 6/2017 Fraser ..... E04H 15/28
2018/0106064 A1 * 4/2018 Barnes ..... E04H 15/30
2020/0221835 A1 * 7/2020 Cox ..... E04H 15/28
2021/0230899 A1 7/2021 Barnes et al.
2021/0404208 A1 12/2021 Barnes et al.
2022/0175098 A1 * 6/2022 James ..... A45B 25/10
2023/0126867 A1 * 4/2023 Barnes ..... E04H 15/44 135/121
2023/0151636 A1 * 5/2023 Li ..... E04H 15/58 135/98
2023/0235592 A1 * 7/2023 Michel ..... E04H 15/28 135/115
2024/0068262 A1 * 2/2024 Cutler ..... E04H 15/405

* cited by examiner

PORTABLE SHADE SYSTEM

TECHNICAL FIELD

The present disclosure is directed to a system and method for providing shade from sunlight.

BACKGROUND

Umbrellas and tents are often used to provide shade from sunlight. These devices have become popular amongst beachgoers. Both umbrellas and tents are known to include a canopy made from a fabric that is securable to a frame, which in turn is anchorable to the ground. Umbrellas and tents may be packaged in a carry bag for transportation and storage. Generally, users desire a stylish yet functional umbrella or tent that is easy to assemble and can withstand environmental conditions.

SUMMARY

In some aspects, the techniques described herein relate to a portable shade system for providing shade from sunlight, including: a frame; a canopy, wherein the canopy includes a first edge and a second edge opposite the first edge, wherein the canopy is connected to the frame adjacent the first edge, wherein the second edge is partially supported by a wind force, wherein the canopy includes pockets adjacent the first edge of the canopy, and wherein the pockets are configured to hold material to maintain a position of the canopy relative to the frame.

In some aspects, the techniques described herein relate to a portable shade system, wherein the canopy includes a main section, a first fin, and a second fin, wherein the first and second fins project from the main section, and wherein the first and second fins each include one of the pockets.

In some aspects, the techniques described herein relate to a portable shade system, wherein the first and second fins are releasably secured to the main section at first and second lateral sides of the main section.

In some aspects, the techniques described herein relate to a portable shade system, wherein the canopy is connected to the frame by a sleeve.

In some aspects, the techniques described herein relate to a portable shade system, wherein the sleeve extends along substantially the entire first edge of the canopy.

In some aspects, the techniques described herein relate to a portable shade system, wherein the frame is connected to a ground surface by a first post and a second post, wherein the first and second posts each have a cavity that is configured to receive a respective end of the frame.

In some aspects, the techniques described herein relate to a portable shade system, wherein the frame includes a plurality of connectable pole segments.

In some aspects, the techniques described herein relate to a portable shade system, wherein the canopy includes a fill line adjacent each of the pockets, wherein the fill lines represent an amount of material that will maintain a position of the canopy relative to the frame.

In some aspects, the techniques described herein relate to a portable shade system, wherein the amount of material is an amount of material weighing between 5 and 10 pounds.

In some aspects, the techniques described herein relate to a portable shade system, wherein the frame curves to form an arch and the pockets face an interior of the arch.

In some aspects, the techniques described herein relate to a portable shade system, wherein the canopy includes other pockets adjacent the first edge of the canopy and configured to hold personal items.

In some aspects, the techniques described herein relate to a portable shade system for providing shade from sunlight, including: a frame; a canopy, wherein the canopy includes a first edge and a second edge opposite the first edge, wherein the canopy is connected to the frame adjacent the first edge, wherein the second edge is partially supported by a wind force, and wherein the canopy includes pockets configured to hold an amount of material weighing between 5 and 10 pounds.

In some aspects, the techniques described herein relate to a portable shade system, wherein the material is a granular material.

In some aspects, the techniques described herein relate to a portable shade system, wherein the material is sand.

In some aspects, the techniques described herein relate to a portable shade system, wherein the canopy includes a main section, a first fin, and a second fin, wherein the first and second fins project from the main section, and wherein the first and second fins each include one of the pockets.

In some aspects, the techniques described herein relate to a portable shade system, wherein the canopy includes a fill line adjacent each of the pockets, wherein the fill lines represents the amount of material.

In some aspects, the techniques described herein relate to a method of assembling a portable shade system, including: filling a pocket of a canopy with material of a weight sufficient to maintain a position of the canopy relative to a frame, with the pocket adjacent the frame.

In some aspects, the techniques described herein relate to a method, wherein the material is sand.

In some aspects, the techniques described herein relate to a method, wherein the weight is between 5 to 10 pounds.

In some aspects, the techniques described herein relate to a method, further including connecting the frame to a ground surface using only first and second posts.

DETAILED DESCRIPTION

Figure 1:
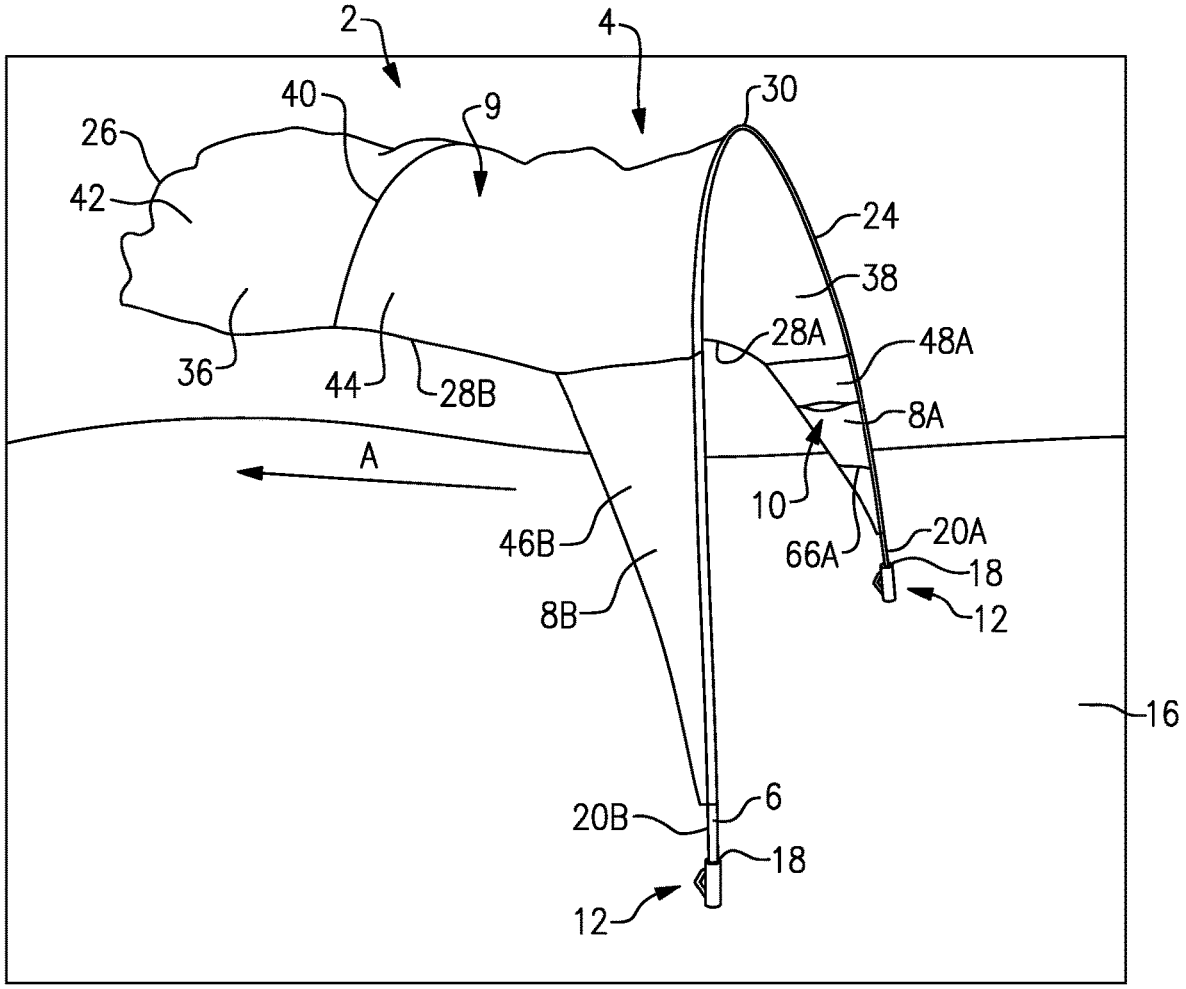
FIG. 1 is a side-perspective view of an exemplary portable shade system being used in a beach environment.

FIG. 1 illustrates an exemplary portable shade system 2. In FIG. 1, the portable shade system 2 is being used in a beach environment. The portable shade system 2 generally includes a canopy 4, frame 6, and screw posts 12. The portable shade system 2 may include other components, such as a carry bag.

In this example, the canopy 4 includes a main section 9 and first and second fins 8A, 8B projecting from opposite sides of the main section 9. The screw posts 12 feature a cavity 18 that is configured to receive the frame 6 at its ends 20A, 20B. The screw posts 12, in turn, are screwed into a ground surface 16 to connect the frame 6 to the ground surface 16, and thereby secure the portable shade system 2. As shown in FIG. 1, when the portable shade system 2 is in use, the frame 6 arches between the screw posts 12. While an arched configuration has certain benefits, the frame 6 is not limited to the arched configuration shown in FIG. 1 and other configurations are within this disclosure.

The canopy 4 of the portable shade system 2 includes a first edge 24, which here is a front edge, and a second edge 26, which here is a rear edge. The main section 9 of the canopy 4 includes a first lateral edge 28A and a second lateral edge 28B. Furthermore, the canopy 4 includes a first side 36, which is generally a top/outer side, and a second side 38, which is generally a bottom/inner side.

The canopy 4 includes a sleeve 30 that is parallel to and adjacent the first edge 24. The second edge 26 is opposite to the first edge 24 and, when the portable shade system 2 is in use, the second edge 26 is at least partially supported by the wind blowing in direction A. The fins 8A, 8B are secured to the lateral edges 28A, 28B of the main section 9 of canopy 4 and secured to the frame 6 by sleeve 30. The fins 8A, 8B are integral to the canopy 4 in this example. The sleeve 30 is a continuous sleeve extending across the entire first edge 24 of the canopy 4, such that the sleeve 30 is formed adjacent each of the fins 8A, 8B and the main section 9.

The fins 8A, 8B each include pockets 10 that are configured to hold material for purposes of weighting down the fins 8A, 8B and/or for holding personal items. The example shown in FIG. 1 has a single pocket 10. However, in other embodiments, the fins 8A, 8B may each include more than one pocket 10, as described below.

Figure 2:
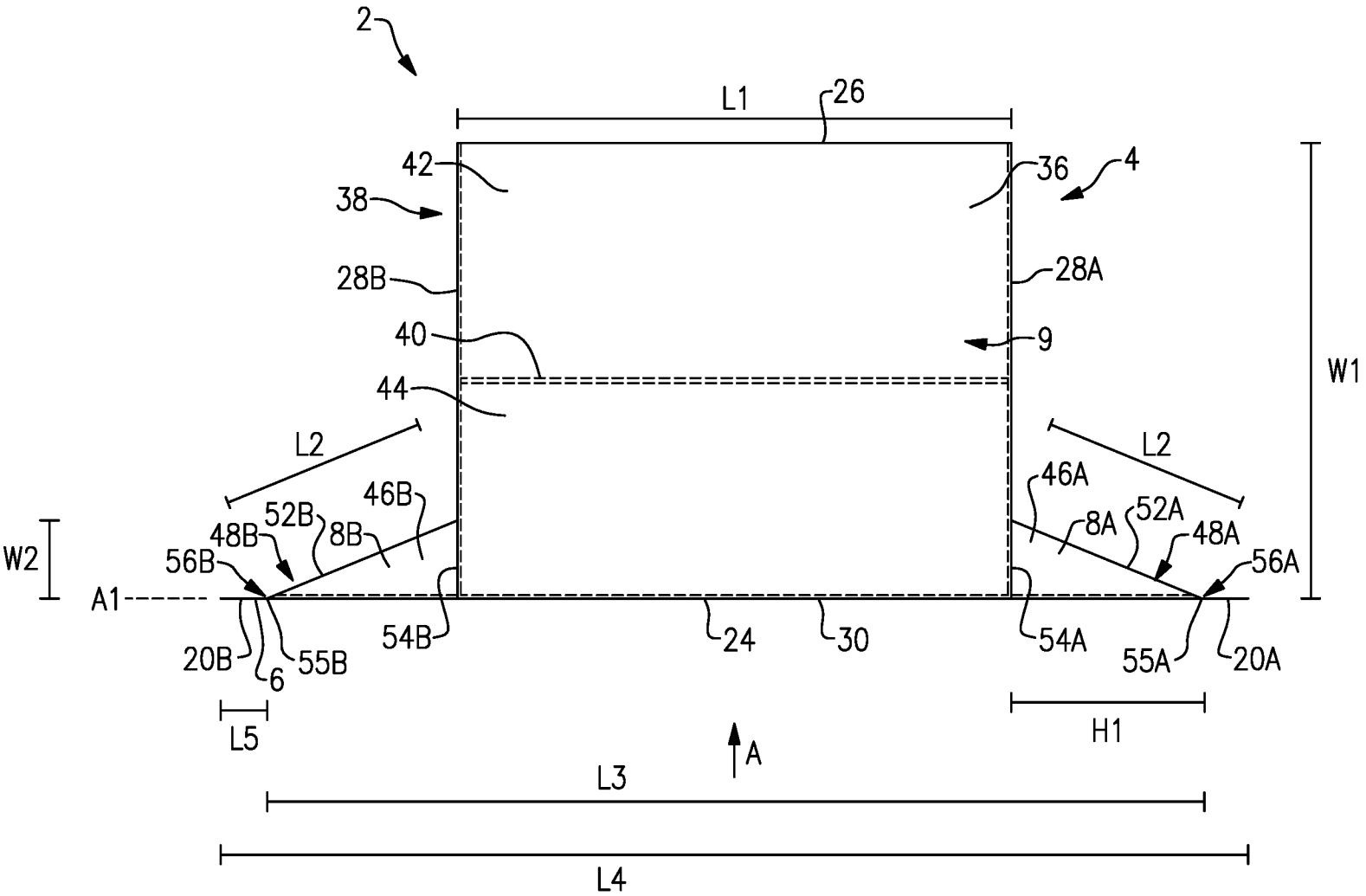
FIG. 2 is a top view of a canopy of the portable shade system.

FIG. 2 is a top-down view of the portable shade system 2. In this example, the main section 9 of the canopy 4 is generally rectangular and exhibits a width W1 between first edge 24 and second edge 26. The main section 9 exhibits a length L1 between the lateral edges 28A, 28B. The main section 9 of the canopy 4 can be formed from a single sheet of fabric or multiple sheets of fabric that are sewn together. In the example shown in FIG. 2, two rectangular sheets 42, 44 are sewn end-to-end together at a midline 40. Furthermore, in this example, the first and second fins 8A, 8B are sewn to the first and second lateral edges 28A, 28B, of the main section 9, respectively, such that the fins 8A, 8B are integral to the canopy 4. In one embodiment, the canopy 4 fabric is a 30D ripstop nylon UV 30+ that is water resistant.

In one embodiment, the length L1 is 138 inches and the width W1 is 57 inches. These dimensions provide significant sun protection without making the system 2 unduly large.

Each of the first and second sheet 42, 44 may have a unique color or pattern for aesthetics. In other embodiments, the portable shade system 2 may include a main section 9 that is constructed from more or fewer than the two sheets 42, 44, and may also include fins 8A, 8B that have different shapes and sizes. The fabric and design chosen for the canopy 4 reduces noise created by the main section 9 when it flaps in high wind conditions. In particular, the fins 8A, 8B, because they are weighted, resist flapping. As a result, a relatively short length of the trailing edge of the canopy 4 is unweighted, which reduces flapping relative to prior designs. The second edge 26 and lateral edges 28A, 28B of the main section 9 are rolled to a thickness of 0.25-0.5 inch to reduce noise and to prevent the canopy 4 from tearing.

As shown in FIG. 2, the fins 8A, 8B are substantially triangular and have a first side 46A, 46B and a second side 48A, 48B that are defined by a first dimension along the first edge 24, a second dimension along a back edge 52A, 52B extending a length L2, and a third dimension along a side edge 54A, 54B extending a width W2. The fins 8A, 8B are secured at its side edge 54A, 54B to the lateral edges 28A, 28B of the main section 9, respectively, such that the first side 46A, 46B of the fins 8A, 8B are flush with the first side 36 of the main section 9. The first edge 24 of the canopy 4 intersects the back edge 52A, 52B of the fins 8A, 8B at a fin tip 55A, 55B. Thus, the first edge 24 of the canopy 4 extends a length L3 from one fin tip 55A to the other fin tip 55B. The dimension of the fins 8A, 8B along the first edge 24 extends a height H1 between the fin tip 55A, 55B and the side edge 54A, 54B.

The fins 8A, 8B can be secured to the main section 9 by a sewing process or releasably secured to the main section 9 by other means such as zipper, hook and loop, or buttons. In one embodiment, the main section 9 and fins 8A, 8B are joined with thread, forming a 0.25-0.5 inch seam. In another embodiment, the fins 8A, 8B are releasably secured to the main section 9 with a zipper so that the fins 8A, 8B are interchangeable and the main section 9 is compatible with fins 8A, 8B of different sizes, shapes, and designs. The fins 8A, 8B may be manufactured from a fabric material substantially similar to that from which the main section 9 is made of or the fins 8A, 8B may be manufactured from a separate fabric, such as nylon oxford, which may be 420D nylon oxford. Furthermore, the fins 8A, 8B may have a pattern or color scheme that is different from or complimentary to the main section 9 design.

During manufacturing, the fabric of the canopy 4 may be rolled and stitched to form the sleeve 30 adjacent and parallel to the first edge 24. In a separate embodiment, the sleeve 30 may be formed from a fabric that is separate from the canopy 4 and sewn adjacent and parallel to the first edge 24. The sleeve 30 is continuous and extends the entire length L3 of the first edge 24 and has openings 56A, 56B adjacent the fins tips 55A, 55B that are configured to receive the frame 6 along axis A1. Furthermore, the sleeve 30 is made from a translucent material so that a user may view the frame 6 as they slide the frame 6 through the sleeve 30 during the process of assembling the system 2.

The frame 6 may be provided by any known type of tent pole. In one example, the frame 6 is comprised of a plurality of pole segments (not shown). Each pole segment has a receiving end and an insertable end that is configured to be received by the receiving end of an adjacent pole segment. The pole segments may be manufactured out of a flexible, light weight metal such as aluminum or another composite. Two of the pole segments are specially configured to be received by the cavity 18 of the screw posts 12 and these poles form the ends 20A, 20B of the frame 6.

As shown in FIG. 2, the frame 6 exhibits a length L4 that is greater than the length L3 of the first edge 24. Thus, the frame 6, as shown in FIG. 2, has ends 20A, 20B that protrude from the sleeve 30 and these ends 20A, 20B are configured to be received by the cavity 18 of the screw posts 12. In one embodiment, the height H1 of the fins 8A, 8B is 48 inches, the length L1 of the main section 9 is 138 inches, and the total length L4 of the frame 6 is 264 inches. Thus, in this embodiment the ends 20A, 20B of the frame 6 protrude a length L5 of 15 inches from the sleeve 30 when the portable shade system 2 is in use. In one embodiment the width W2 of fins 8A, 8B is 18 inches.

Figure 3:
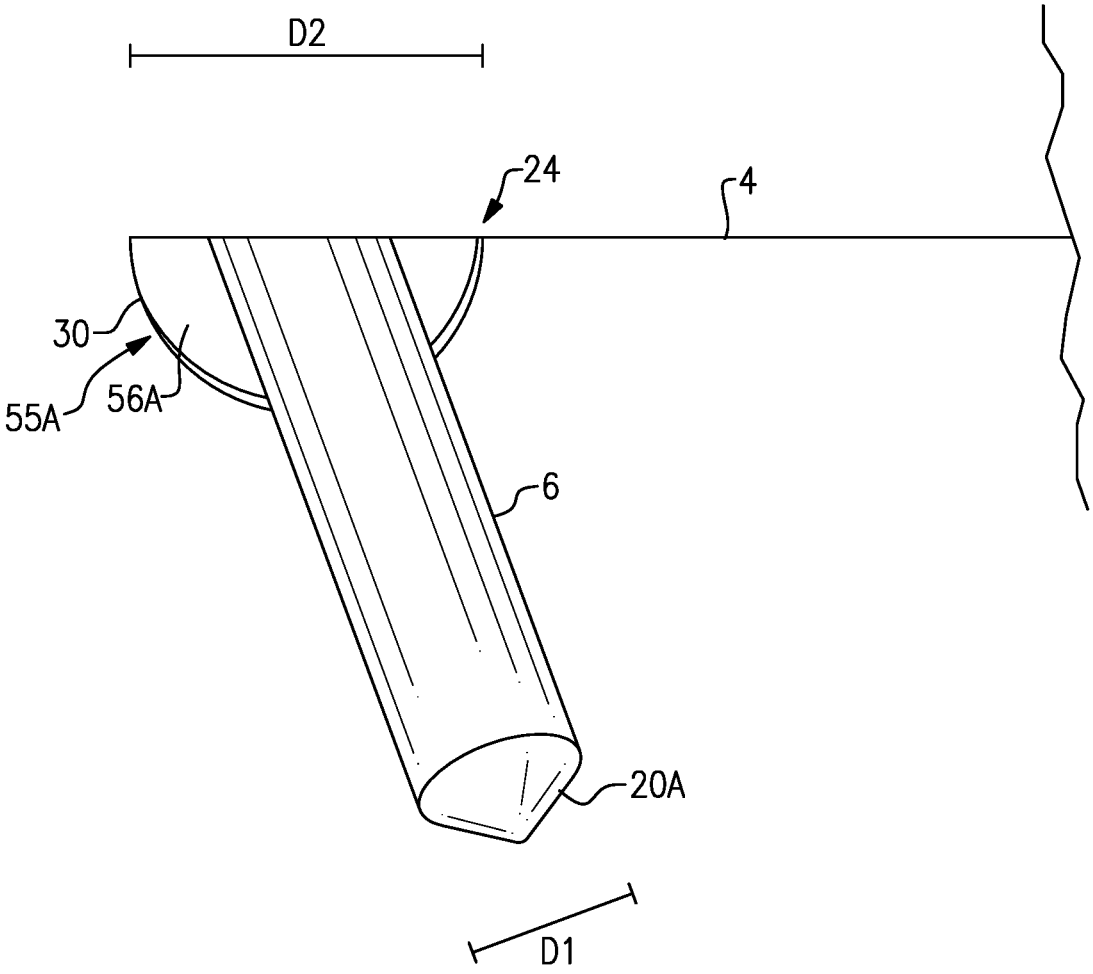
FIG. 3 is a view representative of a sleeve receiving a portion of a frame.

FIG. 3 is a side view representative of sleeve 30 receiving the frame 6 at sleeve opening 56A. Although FIG. 3 is labeled with respect to the sleeve opening 56A near fin tip 55A, it should be understood that the sleeve opening 56B near fin tip 55B is configured in substantially the same manner. The frame 6 has a circular cross section with a diameter d1. As shown in FIG. 3, the sleeve 30 has a cross-section that exhibits a diameter d2. Also, the screw posts 12 have a cross-section that is substantially circular and the cavity 18 within the screw posts 12 has a diameter d3 (see FIG. 5). The diameter d2 of the sleeve 30 and diameter d3 of the cavity 18 are both larger than the diameter d1 of the frame 6 so that the sleeve 30 and cavity 18 can receive the ends 20A, 20B of the frame 6. In one embodiment, the diameter d2 of the sleeve 30 is between 0.5-2 inches and is configured to receive the frame 6 with a diameter d1 of between 0.5-1 inch.

Figure 4:
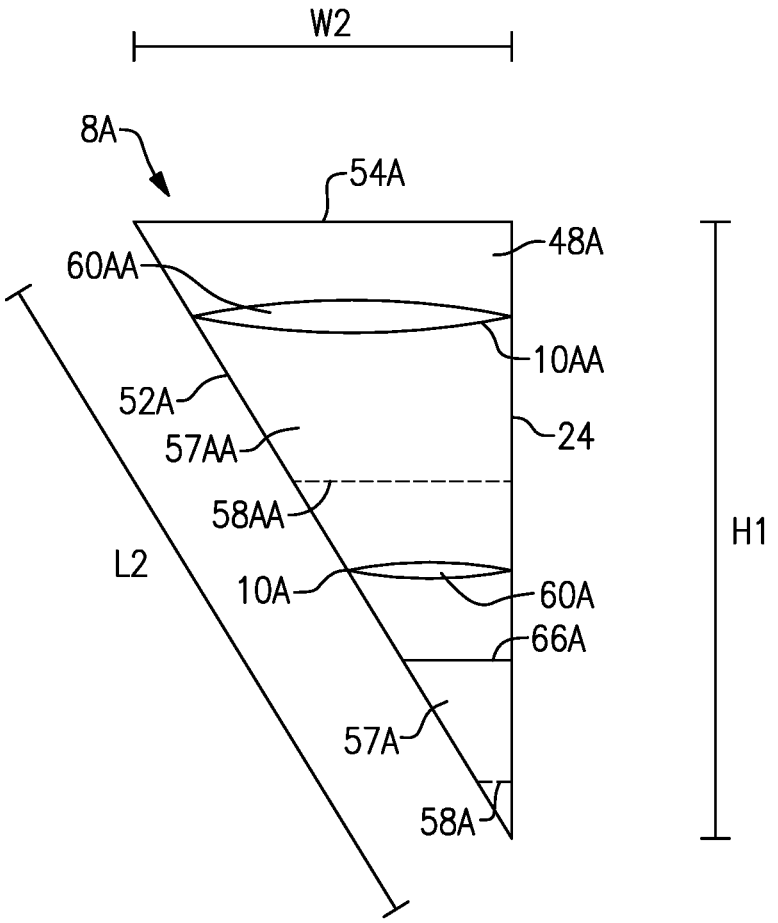
FIG. 4 is a side view of a fin from an interior perspective.

FIG. 4 is a front view of the second side 48A of the fin 8A. Although FIG. 4 shows the fin 8A, the fin 8B is configured similarly. Either the first side 46A, 46B or the second side 48A, 48B of each fin 8A, 8B may have one or more pockets, such as pockets 10A, 10B, configured to hold material that provides weight, and one or more pockets 10AA, 10BB configured to hold personal items, respectively. The embodiment illustrated in FIG. 4 shows a fin 8A with a first pocket 10A positioned below a second pocket 10AA on the second side 48A of the fin. Other pocket 10 configurations are within the scope of the disclosure. For example, in another embodiment, pocket 10A may overlay the second pocket 10AA. The pockets 10 are manufactured by securing one or more pocket tabs 57, which are pieces of fabric, to the second side 48A, 48B of the fins 8A, 8B. The embodiment shown in FIG. 4 features two pocket tabs 57A, 57AA that form pockets 10A, 10AA respectively.

The pocket tabs 57 are sheets of fabric constructed from a marine strength nylon to increase strength and durability, in one example. First, the pocket tabs 57 are sewn along the back edge 52A, 52B and front edge 24 of the fins 8A, 8B. A seam 58 is then sewn across the pocket tabs 57 from the front edge 24 to the back edge 52A, 52B of the fin 8A, 8B and this seam 58 represents the bottom of the pocket tab 57. In some embodiments, the pockets 10 may only extend across a portion of the fins 8A, 8B from the front edge 24 to the back edge 52A, 52B. The embodiment shown in FIG. 4, has two seams 58A, 58AA that correspond to the bottom of pockets 10A and 10AA respectively. The embodiment shown in FIG. 4 features two pockets 10A, 10AA with pocket openings 60A, 60AA respectively. The pocket tabs 57 are sewn so that the seams 58 are internal to the pockets 10 and canopy 4 such that the seams 58 are out of view.

The pockets 10A, 10B are configured to hold material used to weight down the canopy 4 to maintain a position of the canopy 4 relative to the frame 6. The canopy 4 and/or the pockets 10A, 10B may include a fill line 66A, 66B. Here, the fill lines 66A, 66B are on the outside of the pocket tab 57A, 57B. The fill line 66A, 66B represents a volume of a designated material corresponding to a certain weight that is able to keep the canopy 4 from moving relative to the frame 6 and to balance the system 2 with the wind blowing in direction A. Furthermore, the amount of material added to the pockets 10 is relatively light as to not overload the frame 6. Further still, the amount of material is set so as to not take an undue amount of time for a user to fill during the assembly process. As such, in an example, the user will fill the pockets 10A, 10B with the designated material until the pockets 10A, 10B are filled to the fill line 66A, 66B. For example, the fill line 66A, 66B may correspond to the amount of sand (such as typical beach sand), dirt, or gravel that needs to be added to the pockets 10A, 10B in order to balance the system 2 and prevent the canopy 4 from moving relative to the frame 6. In one embodiment, the fill line 66A, 66B on pockets 10A, 10B corresponds to the amount of sand equaling 5-10 pounds in weight. The amount of material required to balance the system 2 may vary depending on the size of the canopy 4, or the wind conditions of a particular environment. With this disclosure, there is no need for an anchor or weighting mechanism separate from the pockets 10 and screw posts 12. In other words, the system 2 is only anchored directly to the ground surface 16 by the posts 12. Specifically, the frame 6 is only connected to the ground surface 16 by the posts 12 and not by other structures or devices. This aspect of this disclosure increases the ease of assembly and reduces the number of component parts required of the design.

Figure 5:
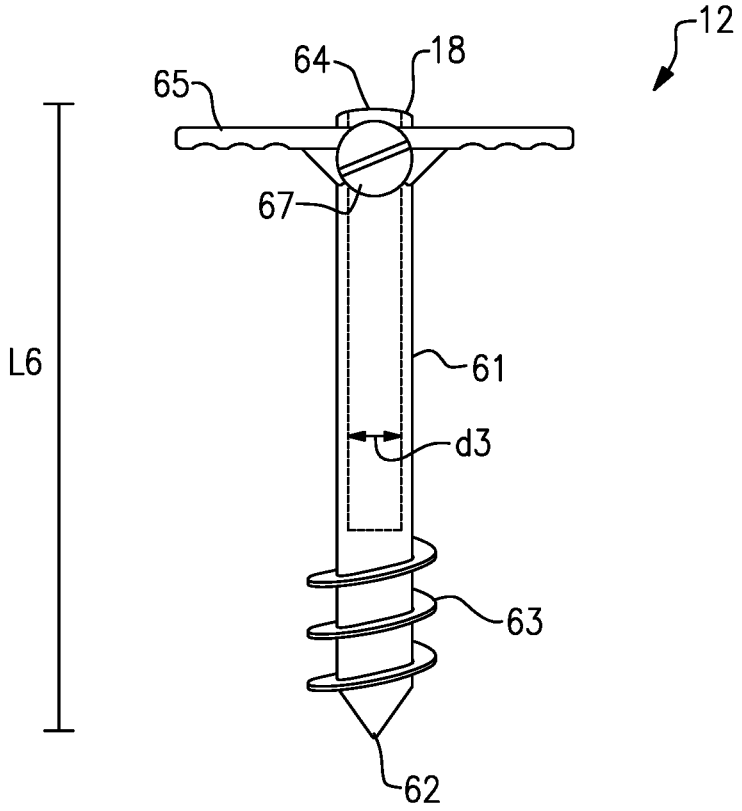
FIG. 5 is a front view of an exemplary screw post.

FIG. 5 is a front view of an example screw post 12. The screw post 12 comprises a rod 61 having an inserting end 62 and a receiving end 64 opposite to the inserting end 62. The rod 61 is hollow and features a cavity 18 at the receiving end 64 configured to receive the frame ends 20A, 20B. The cavity 18 partially extends along an interior of the rod 61 to the inserting end 62. The screw posts 12 further include a handle 65 projecting perpendicularly from the exterior of the rod 61 adjacent the receiving end 64. The handle 65 is used to twist the post 12 into the ground surface 16. The inserting end 62 includes threads 63 to facilitate the process of screwing the post 12 into the ground surface 16. Furthermore, the screw posts 12 may include a fastener 67 extending through rod 61 into the cavity 18 in order to create a pressure fit with the frame end 20A, 20B received in the cavity 18. The screw posts 12 extend a length L6. In one embodiment, the screw posts 12 extend a length L6 of approximately 15 inches. The screw posts 12 are designed to be lightweight and are manufactured from a hard plastic or other composite to prevent corrosion. Two screw posts 12 are included with the portable shade system 2. The screw post 12 of FIG. 5 is exemplary and other types of screw posts and anchors configured to hold the frame 6 come within the scope of this disclosure.

Figure 6:
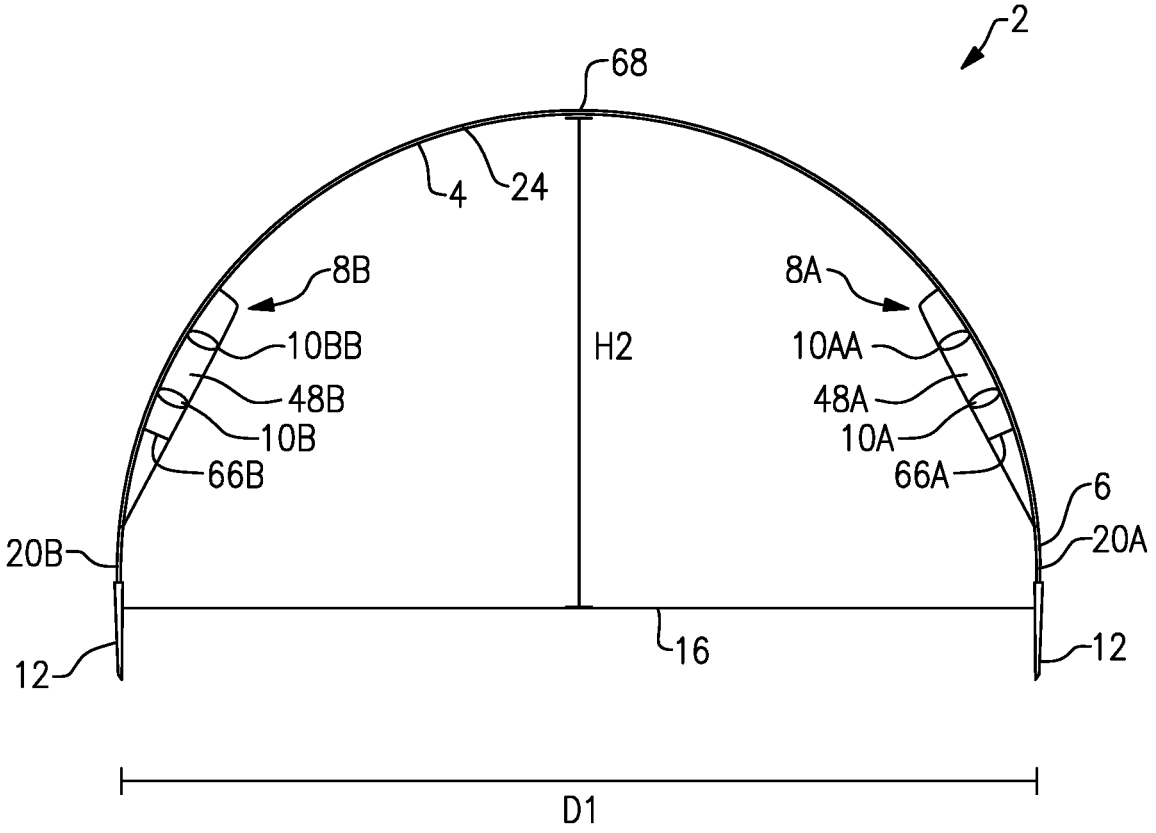
FIG. 6 is a front view of the portable shade system.
Figure 7:
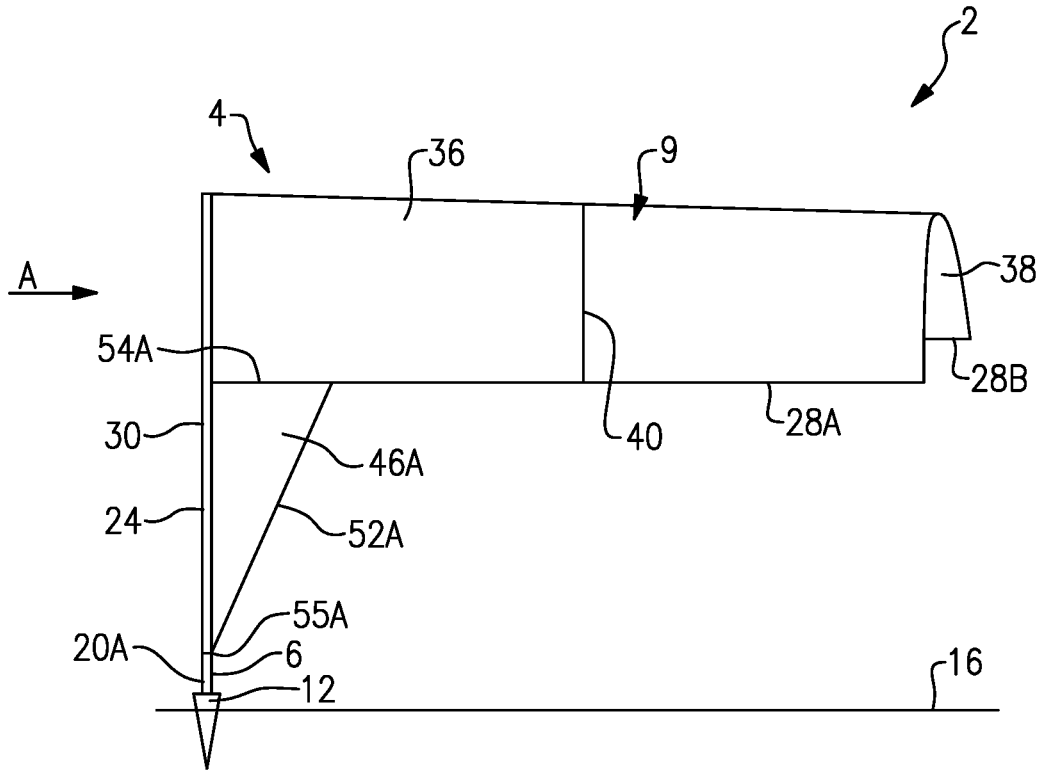
FIG. 7 is a side view of the portable shade system.

FIG. 6 is a front view of the portable shade system 2 anchored to the ground surface 16 and FIG. 7 is a side view of the same. The following details an example method for assembling the portable shade system 2. Each of the canopy 4, frame 6, fins 8A, 8B, and screw posts 12 are packaged in a carry bag (not shown) for storage. To assemble the portable shade system 2, a user first unpacks the system 2 from the carry bag. Next, the user spaces the two screw posts 12 a distance D1 from each other and then twists the screw posts 12 partially into the ground surface 16. Generally, the portable shade system 2 can be used on any penetrable, ground surface 16 comprising granules such as dirt, gravel, and sand. The user then passes the frame 6 through the sleeve 30, and attaches the ends of the frame 6 to the screw posts 12.

Generally, the frame 6 forms an arch having a height H2 at a midpoint 68 of the frame 6, which corresponds to the apex of the arch. The distance D1 between the screw posts 12 is less than the length L4 of the frame 6. In one embodiment, the frame length L4 is 264 inches and the screw posts 12 are spaced a distance D1 of 150 inches. Thus, in this embodiment, the midpoint 68 of the frame has a height H2 of approximately 78-90 inches. Accordingly, the user may adjust the height H2 to their liking by adjusting the distance D1 between the screw posts 12.

Finally, with the canopy 4 and fins 8A, 8B secured to the frame 6 and the frame 6 anchored in the ground surface 16, a user adds material such as sand to the fin pockets 10A, 10B. Because the weight of the sand holds the canopy 4 relative to the frame 6, the fins 8A, 8B may be referred to as anchor fins. As shown in FIG. 4, the first pockets 10A, 10B, are filled with sand up to the respective fill lines 66A, 66B. For example, a portable shade system 2 specifically purposed for beachgoers may have a fill line 66A, 66B on the pockets 10A, 10B that corresponds to the amount of sand that needs to be added to the pockets 10A, 10B. Thus, the user will scoop sand from the beach into the pockets 10A, 10B until the sand level is even with the fill line 66A, 66B. Optionally, a user can put extra equipment or personal items into the other pockets 10AA, 10BB that are not being used to hold sand.

It should be understood that directional terms are used above with reference to the normal operational attitude of the system 2 as shown in the drawings. Further, these terms have been used herein for purposes of explanation, and should not be considered otherwise limiting. Terms such as "generally," "substantially," and "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples. In addition, the various figures accompanying this disclosure are not necessarily to scale, and some features may be exaggerated or minimized to show certain details of a particular component or arrangement.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. A portable shade system for providing shade from sunlight, comprising:

a frame; and a canopy, wherein the canopy includes a first edge and a second edge opposite the first edge, wherein the canopy is connected to the frame adjacent the first edge, wherein the second edge is partially supported by a wind force, wherein the canopy includes pockets adjacent the first edge of the canopy, and wherein the pockets are configured to hold material to maintain a position of the canopy relative to the frame, wherein the canopy includes a main section, a first fin, and a second fin, wherein the first and second fins project from the main section, and wherein the first and second fins each include one of the pockets.

2. The portable shade system as recited in claim 1, wherein the first and second fins are releasably secured to the main section at first and second lateral sides of the main section.

3. The portable shade system as recited in claim 1, wherein the canopy is connected to the frame by a sleeve.

4. The portable shade system as recited in claim 3, wherein the sleeve extends along substantially the entire first edge of the canopy.

5. The portable shade system as recited in claim 1, wherein the frame is connected to a ground surface by a first post and a second post, wherein the first and second posts each have a cavity that is configured to receive a respective end of the frame.

6. The portable shade system as recited in claim 1, wherein the frame comprises a plurality of connectable pole segments.

7. The portable shade system as recited in claim 1, wherein the frame curves to form an arch and the pockets face an interior of the arch.

8. The portable shade system as recited in claim 1, wherein the canopy includes other pockets adjacent the first edge of the canopy and configured to hold personal items.

9. A portable shade system for providing shade from sunlight, comprising:

a frame; and a canopy, wherein the canopy includes a first edge and a second edge opposite the first edge, wherein the canopy is connected to the frame adjacent the first edge, wherein the second edge is partially supported by a wind force, wherein the canopy includes pockets adjacent the first edge of the canopy, and wherein the pockets are configured to hold material to maintain a position of the canopy relative to the frame, wherein the canopy includes a fill line adjacent each of the pockets, wherein the fill lines represent an amount of material that will maintain a position of the canopy relative to the frame.

10. The portable shade system as recited in claim 9, wherein the amount of material is an amount of material weighing between 5 and 10 pounds.

11. A portable shade system for providing shade from sunlight, comprising:

a frame; and a canopy, wherein the canopy includes a first edge and a second edge opposite the first edge, wherein the canopy is connected to the frame adjacent the first edge, wherein the second edge is partially supported by a wind force, and wherein the canopy includes pockets configured to hold an amount of material weighing between 5 and 10 pounds, wherein the canopy includes a fill line adjacent each of the pockets, wherein the fill line represents the amount of material.

12. The portable shade system as recited in claim 11, wherein the material is a granular material.

13. The portable shade system as recited in claim 12, wherein the material is sand.

14. The portable shade system as recited in claim 11, wherein the canopy includes a main section, a first fin, and a second fin, wherein the first and second fins project from the main section, and wherein the first and second fins each include one of the pockets.

* * * * *